US009702591B2

(12) United States Patent
Yamamoto et al.

(10) Patent No.: US 9,702,591 B2
(45) Date of Patent: Jul. 11, 2017

(54) HOT WATER SUPPLY SYSTEM

(75) Inventors: Takaya Yamamoto, Chiyoda-ku (JP); Motohiko Kawagishi, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 334 days.

(21) Appl. No.: 14/406,858

(22) PCT Filed: Jun. 25, 2012

(86) PCT No.: PCT/JP2012/004107

§ 371 (c)(1),
(2), (4) Date: Dec. 10, 2014

(87) PCT Pub. No.: WO2014/002131

PCT Pub. Date: Jan. 3, 2014

(65) Prior Publication Data

US 2015/0159913 A1 Jun. 11, 2015

(51) Int. Cl.
*F24H 9/20* (2006.01)
*F24D 17/02* (2006.01)
(Continued)

(52) U.S. Cl.
CPC ..... *F24H 9/2007* (2013.01); *F24D 17/02* (2013.01); *F24D 19/1054* (2013.01);
(Continued)

(58) Field of Classification Search
CPC ..... F23N 204/04; F24H 9/2007; F24H 1/18; F24D 4/04; G05B 13/0265; G05B 13/041;
(Continued)

(56) References Cited

U.S. PATENT DOCUMENTS 6,208,806 B1 * 3/2001 Langford ..... F24H 9/2021 392/449
6,293,471 B1 * 9/2001 Stettin ..... F24H 9/2021 165/268
(Continued)

FOREIGN PATENT DOCUMENTS

JP 2004 317038 11/2004
JP 2005 76968 3/2005
(Continued)

OTHER PUBLICATIONS

Extended European Search Report issued Feb. 24, 2016 in Patent Application No. 12880263.4.
(Continued)

*Primary Examiner* — Alissa Tompkins
*Assistant Examiner* — Nathaniel Herzfeld
(74) *Attorney, Agent, or Firm* — Oblon, McClelland, Maier & Neustadt, L.L.P.

(57) ABSTRACT

An operation plan correction unit is included which, after start of operation based on an operation plan, predicts a subsequent hot water supply load at a predetermined day on the basis of a hot water supply load result at the predetermined day, and changes a subsequent operation plan at the predetermined day generated by an operation plan generation unit, on the basis of the hot water supply load predicted again and a remaining amount of stored hot water in a hot water storage tank.

9 Claims, 8 Drawing Sheets

(51) Int. Cl.
*F24D 19/10* (2006.01)
*F24H 1/18* (2006.01)
*F24H 4/04* (2006.01)

(52) U.S. Cl.
CPC ..... *F24D 19/1063* (2013.01); *F24H 1/18* (2013.01); *F24H 4/04* (2013.01); *F24D 2200/12* (2013.01); *F24D 2220/042* (2013.01); *F24D 2220/044* (2013.01); *F24D 2220/08* (2013.01)

(58) Field of Classification Search
CPC .. G05B 13/042; G05D 23/00; G05D 23/1904; G05D 23/1917; G05D 23/1951
See application file for complete search history.

(56) References Cited

U.S. PATENT DOCUMENTS

2005/0268865 A1* 12/2005 Valbh ..... F24H 9/2007 122/14.1
2006/0173653 A1* 8/2006 Chian ..... F24H 9/2007 702/182
2012/0118989 A1* 5/2012 Buescher ..... F24H 9/2021 237/8 A
2012/0209439 A1* 8/2012 Inoue ..... G06Q 10/04 700/291
2012/0235478 A1* 9/2012 Hayashida ..... F24D 17/02 307/11
2013/0213069 A1* 8/2013 Elliott ..... F25B 30/06 62/213
2013/0327313 A1* 12/2013 Arnold ..... F24H 9/2007 126/344
2014/0217187 A1* 8/2014 Wen ..... F24H 9/2007 236/25 R
2014/0277817 A1* 9/2014 Stevens ..... G05D 23/1917 700/300

FOREIGN PATENT DOCUMENTS

JP 2007 32879 2/2007
JP 2009 133559 6/2009
JP 2010 32212 2/2010
JP 2010 203633 9/2010
JP 2012 97950 5/2012

OTHER PUBLICATIONS

International Search Report Issued Aug. 7, 2012 in PCT/JP12/004107 Filed Jun. 25, 2012.

* cited by examiner (a)

(b)

(*) ASSUME THAT 1 kWh HEAT IS SUPPLIED WITH 5-MINUTE OPERATION

| | 3 P.M. TO 6 P.M. | 6 P.M. TO 9 P.M. | 9 P.M. TO 12 A.M. | 12 A.M. TO 3 A.M. | SQUARE ERROR |
|---|---|---|---|---|---|
| LOAD RESULT | 3 | 12 | — | — | — |
| CLUSTER 1 | 5 | 10 | 20 | 3 | 8 (*1) |
| CLUSTER 2 | 5 | 20 | 10 | 3 | 68 (*2) |
| CLUSTER 3 | 10 | 2 | 20 | 3 | 149 (*3) |

(*1) $8=(3-5)^2+(12-10)^2$
(*2) $68=(3-5)^2+(12-20)^2$
(*3) $149=(3-10)^2+(12-2)^2$

HOT WATER SUPPLY SYSTEM

TECHNICAL FIELD

The present invention relates to a hot water supply system.

BACKGROUND ART

A hot water supply system includes a heat source unit such as a heat pump or a boiler and a hot water storage tank that stores hot water, and is able to store hot water in the hot water storage tank by using the heat of a heat medium heated by the heat source unit. The hot water stored in the hot water storage tank is used for the application of hot water supply for a shower or a bath, a kitchen, or the like.

A method for generating hot water to be stored in the hot water storage tank includes a direct heating method in which hot water heated by the heat source unit is stored directly in the hot water storage tank; and an indirect heating method in which heat is exchanged between a refrigerant or a heat medium heated by the heat source unit and hot water in the hot water storage tank.

As a hot water supply system employing the direct heating method, there is a hot water supply system that includes a heat pump having high energy efficiency as a heat source unit, and a large-capacity hot water storage tank, and boils a large amount of hot water at late night at which the electricity unit price is low.

In addition, as a hot water supply system employing the indirect heating method, a system has been proposed which includes a water heat exchanger that exchanges heat between a refrigerant flowing through a primary side circuit and water flowing through a secondary side circuit and in which heating energy of the refrigerant heated by a heat source unit is transmitted via the water heat exchanger to the water flowing through the secondary side circuit, thereby generating hot water (see, e.g., Patent Literature 1).

In the technique described in Patent Literature 1, when an amount of heat in a hot water storage tank is insufficient, reheating of water is performed to increase the amount of heat. Prior to the reheating, a hot water supply load for the current day is predicted on the basis of a load result for past 7 days, and, at the day of control, when the load result becomes greater than a predicted load for four hours later, reheating is performed with the difference between the load result and a predicted load at the current time as an additional amount of heat to be stored. By so doing, when the time slot when a hot water supply load is generated is a time slot before a time slot in which the prediction is made, it is possible to make an amount of reheating appropriate. Thus, it is possible to suppress an unnecessary reheating operation to improve the energy saving property of the hot water supply system.

CITATION LIST

Patent Literature

Patent Literature 1: Japanese Unexamined Patent Application Publication No. 2010-32212 (see, e.g., FIGS. 1 to 5)

SUMMARY OF INVENTION

Technical Problem

The technique described in Patent Literature 1 assumes that the entirety or most part of a total amount of required heat for 1 day that is predicted on the basis of a past load result is generated through boiling at late night. In order to reduce the risk of hot water shortage, in many cases, there is a high possibility that excessive boiling has been performed at the time of late-night boiling. Thus, when a hot water supply load result at the day of control falls below the predicted hot water supply load, the energy saving property is impaired.

In addition, in the case of a hot water supply system including a hot water storage tank with a low capacity or a hot water supply system that cannot store water at high temperature due to low capacity of a heat source unit, it is difficult to perform boiling at one time for the entirety or most part of a total amount of heat required for 1 day, and it is necessary to perform boiling or reheating several times in 1 day. This impairs the energy saving property.

The present invention has been made in order to solve the problems as described above, and an object of the present invention is to provide a hot water supply system that achieves improvement of an energy saving property thereof.

Solution to Problem

A hot water supply system according to the present invention includes: a hot water storage tank that stores water; a boiling unit that is a heating source that heats the water stored in the hot water storage tank; and a controller that determines an amount of heat to be generated by the boiling unit, for each time slot in order to heat the water stored in the hot water storage tank. The controller includes: a hot water supply load data storage unit that stores hot water supply load data generated on the basis of at least a water temperature of water flowing into the hot water storage tank and a water temperature and a flow rate of water flowing out from the hot water storage tank, for a plurality of days; a hot water supply load data analysis unit that analyzes the hot water supply load data for the plurality of days stored in the hot water supply load data storage unit; an operation plan generation unit that predicts a hot water supply load for a predetermined day ahead of the plurality of days stored in the hot water supply load data storage unit, on the basis of the analysis by the hot water supply load data analysis unit, and generates an operation plan for the boiling unit at the predetermined day; and an operation plan correction unit that, after start of operation based on the operation plan, predicts a subsequent hot water supply load at the predetermined day on the basis of a hot water supply load result at the predetermined day, and changes the subsequent operation plan at the predetermined day generated by the operation plan generation unit, on the basis of the hot water supply load predicted again and a remaining amount of stored hot water in the hot water storage tank. The hot water supply load data analysis unit classifies the hot water supply load data for the plurality of days stored in the hot water supply load data storage unit, into a plurality of groups. The operation plan generation unit selects one of the plurality of classified groups having an occurrence frequency higher than a predetermined probability and generates an operation plan for the boiling unit on the basis of hot water supply load data of the selected group. The operation plan correction unit selects at least one of the groups having a low error from a hot water supply load result at the predetermined day after start of operation based on the operation plan, and generates the subsequent operation plan at the predetermined day on the basis of the selected hot water supply load data.

Advantageous Effects of Invention

With the hot water supply system according to the present invention, on the basis of a hot water supply load predicted again and a remaining amount of stored hot water in the hot water storage tank, a subsequent operation plan at the predetermined day generated by the operation plan generation unit is changed, thereby allowing the energy saving property to be improved.

DESCRIPTION OF EMBODIMENTS

Hereinafter, embodiments of the present invention will be described with reference to the drawings.

Embodiment 1

Figure 1:
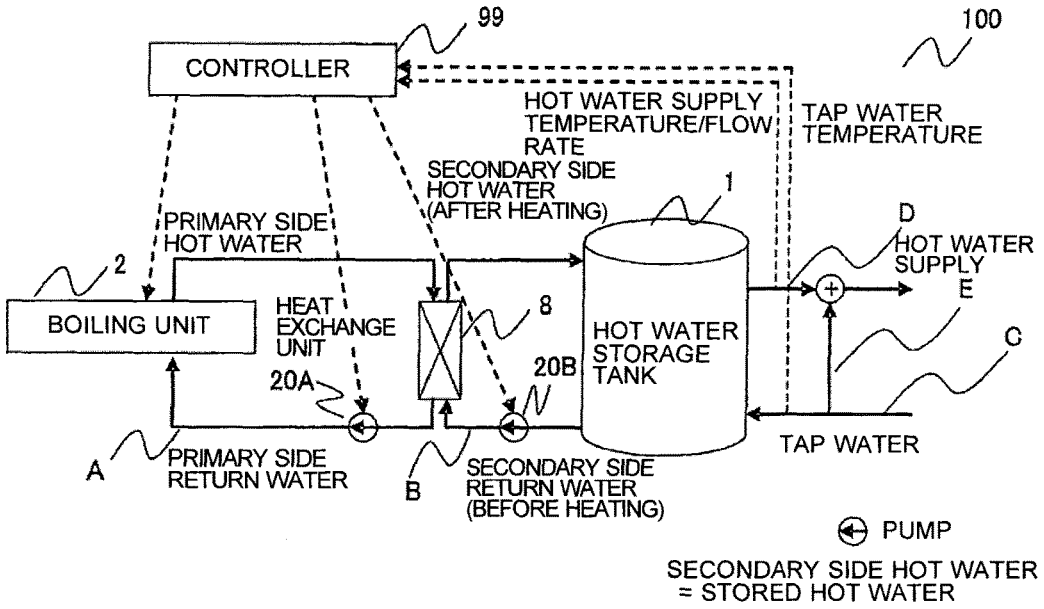
FIG. 1 is a configuration diagram of a hot water supply system according to Embodiment 1 of the present invention.

FIG. 1 is a configuration diagram of a hot water supply system 100 according to Embodiment 1. The configuration of the hot water supply system 100 will be described with reference to FIG. 1.

The hot water supply system 100 according to Embodiment 1 has been improved to allow the energy saving property of the hot water supply system 100 to be improved, for example, even in the case where a hot water supply load result at the day of control falls below a predicted hot water supply load, even in the case of a hot water supply system including a hot water storage tank with a low capacity, even in the case where the capacity of a heat source unit is so low that it is not possible to store hot water at high temperature, or the like.

[Explanation of Configuration]

As shown in FIG. 1, the hot water supply system 100 includes a hot water storage tank 1 that is able to store water, a boiling unit 2 that generates hot water, a heat exchange unit 8 that exchanges heat between waters supplied thereto, a primary side pump 20A and a secondary side pump 20B for conveying water, and a controller 99 that controls a flow rate of water, a hot water supply temperature, and the like.

The hot water supply system 100 includes: a primary side circuit A that is a heat source side circuit formed by the boiling unit 2, the heat exchange unit 8, and the primary side pump 20A being connected to each other; and a secondary side circuit B that is a use side circuit formed by the hot water storage tank 1, the heat exchange unit 8, and the secondary side pump 20B being connected to each other. In the following, a description will be given on the assumption that water flows through the primary side circuit A, but a refrigerant, a brine, a heat medium, or the like may flow therethrough.

(Hot Water Storage Tank 1)

The hot water storage tank 1 is able to store water heated by the heat exchange unit 8 and is connected to a water inflow side of the secondary side pump 20B and a water outflow side of the heat exchange unit 8.

In addition, as shown by an arrow C in FIG. 1, the hot water storage tank 1 is configured such that tap water is supplied into the hot water storage tank 1. Furthermore, as shown by an arrow D in FIG. 1, the hot water storage tank 1 is configured to be able to supply water stored in the hot water storage tank 1, to a shower, a kitchen, and the like. As shown by an arrow E in FIG. 1, water flowing out from the hot water storage tank 1 is mixed with low-temperature tap water such that the temperature thereof is adjustable to a temperature required by a user.

(Boiling Unit 2)

The boiling unit 2 is a heat source unit composed of, for example, a heat pump, a boiler, or the like. The boiling unit 2 heats low-temperature primary side return water returning from the heat exchange unit 8, and supplies the water as primary side hot water to the heat exchange unit 8.

(Heat Exchange Unit 8)

The heat exchange unit 8 exchanges heat between water in the primary side circuit A supplied from the boiling unit 2 and hot water in the secondary side circuit B supplied from the hot water storage tank 1 (hereinafter, also referred to as stored hot water). The heat exchange unit 8 may be composed of, for example, a double tube heat exchanger that is able to exchange heat between water flowing through the primary side circuit A and water flowing through the secondary side circuit B.

(Primary Side Pump 20A and Secondary Side Pump 20B)

The primary side pump 20A conveys the water in the primary side circuit A. In other words, the primary side pump 20A conveys water that has flowed out from the heat exchange unit 8 and has a temperature lowered through heat exchange at the heat exchange unit 8 (primary side return water), to the boiling unit 2.

The secondary side pump 20B conveys the water in the secondary side circuit B. In other words, the secondary side pump 20B conveys water that has flowed out from the hot water storage tank 1 and has a temperature increased through heat exchange at the heat exchange unit 8, to the boiling unit 2.

The position at which the primary side pump 20A is provided is not limited to a pipe through which the primary side return water flows, and may be a pipe through which the primary side hot water flows. In other words, the position at which the primary side pump 20A is provided may be the downstream side of the heat exchange unit 8 and the upstream side of the heat exchange unit 8. In addition, the position at which the secondary side pump 20B is provided is not limited to a pipe through which water flowing out from the hot water storage tank 1 flows. In other words, the position at which the secondary side pump 20B is provided may be the downstream side of the heat exchange unit 8 and the upstream side of the hot water storage tank 1.

(Controller 99)

The controller 99 generates operation plans for the boiling unit 2, the primary side pump 20A, and the secondary side pump 20B on the basis of the temperature and the flow rate of the water of the arrow D and the temperature of the water of the arrow C shown in FIG. 1. The controller 99 controls the boiling unit 2, the primary side pump 20A, and the secondary side pump 20B on the basis of the generated operation plans.

The operation plans to be generated by the controller 99 are obtained by the controller 99 analyzing data of past hot water supply loads and calculating a hot water supply load pattern that is typical for the user. The controller 99 has a function to change the generated operation plans on the basis of a predetermined rule. The detailed configuration of the controller 99 will be described with reference to FIG. 2.

The controller 99 may supply makeup water (low-temperature tap water) to the hot water storage tank 1 such that the tank is always kept full, or may supply makeup water (low-temperature tap water) to the hot water storage tank 1 after the water level in the hot water storage tank 1 is lowered to a predetermined water level. In the latter case, a flow control valve or the like is provided on a tap water pipe leading to the hot water storage tank 1, and the controller 99 controls the water level in the hot water storage tank 1. In the following, unless otherwise noted, a description will be given on the assumption that the hot water storage tank 1 is always kept full.

Figure 2:
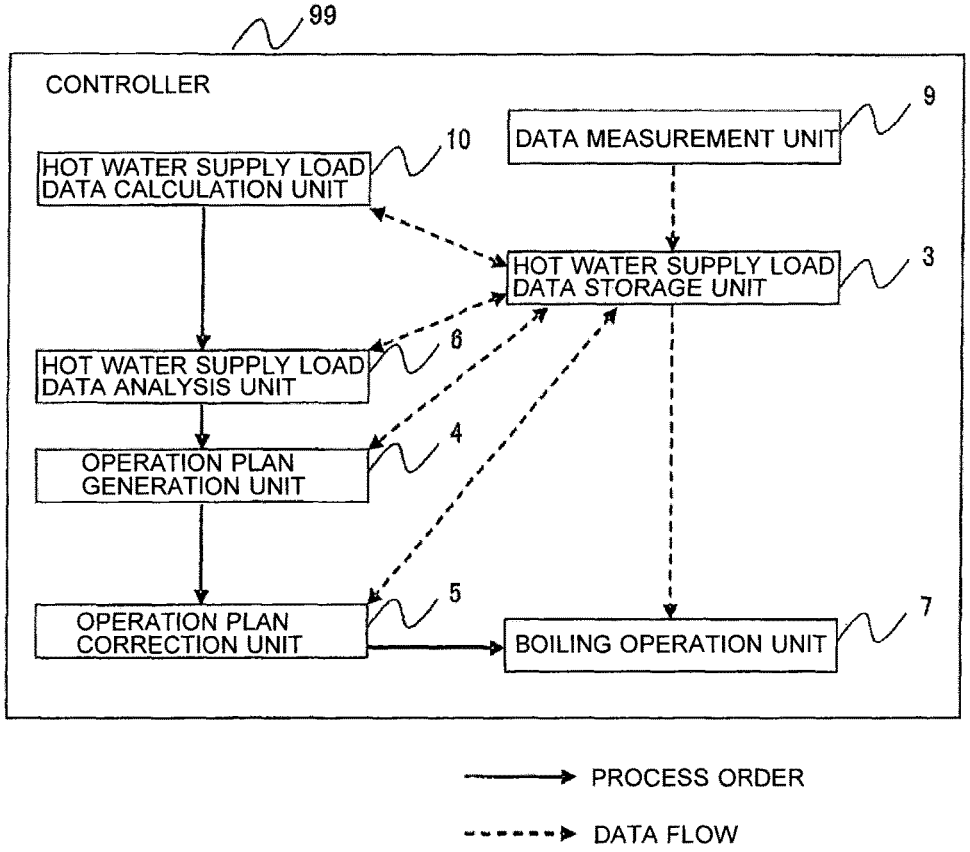
FIG. 2 is a block diagram showing a functional configuration of a controller shown in FIG. 1.

FIG. 2 is a block diagram showing a functional configuration of the controller 99 shown in FIG. 1. The detailed configuration of the controller 99 will be described with reference to FIG. 2.

The controller 99 includes a data measurement unit 9 that measures a water temperature and the like, a hot water supply load data calculation unit 10 that performs predetermined calculation on the basis of data stored in a later-described hot water supply load data storage unit 3, and the hot water supply load data storage unit 3 that stores calculation results of the data measurement unit 9, the hot water supply load data calculation unit 10, and the like.

In addition, the controller 99 includes a hot water supply load data analysis unit 6 that performs analysis based on a time slot on the calculation result of the hot water supply load data calculation unit 10, an operation plan generation unit 4 that generates an operation plan for the boiling unit 2 on the basis of an analysis result of the hot water supply load data analysis unit 6, an operation plan correction unit 5 that reviews the operation plan generated by the operation plan generation unit 4, and a boiling operation unit 7 that adjusts an amount in the boiling unit 2 on the basis of the operation plan reviewed by the operation plan correction unit 5.

(Data Measurement Unit 9)

The data measurement unit 9 is a sensor that measures a water temperature and a flow rate. More specifically, the data measurement unit 9 measures a hot water supply temperature T1 and a hot water flow rate W1 of water (the water temperature of the arrow D in FIG. 1) that has flowed out from the hot water storage tank 1 and has not joined tap water, at a predetermined cycle as data required for calculating hot water supply load data at the hot water supply load data calculation unit 10. In addition, the data measurement unit 9 measures a water temperature T2 (the water temperature of the arrow C in FIG. 1) of tap water supplied to the hot water storage tank 1, at a predetermined cycle.

Here, the data measurement unit 9 is configured to measure the hot water flow rate W1, for example, by measuring a hot water storage tank water level. In addition, the measuring cycles of the hot water supply temperature T1, the hot water flow rate W1, and the water temperature T2 are cycles shorter than a time interval at which the hot water supply load data calculation unit 10 calculates hot water supply load data, such as 10 seconds or 1 minute.

In the case where the controller 99 performs control such that the hot water storage tank 1 is always filled with water, the data measurement unit 9 may measure a flow rate of tap water supplied to the hot water storage tank 1 instead of the measurement of the hot water flow rate W1 and use the flow rate as data for calculation of hot water supply load data. This is because, in this case, the flow rate of water supplied to the hot water storage tank 1 and the flow rate of water flowing out from the hot water storage tank 1 are the same.

Alternatively, the data measurement unit 9 may be configured not to measure the water temperature T2 of the tap water by the sensor. In this case, an estimated value of a water temperature at each time (may be a fixed value that does not vary with time) may be allowed to be previously settable by the user, or may be allowed to be automatically calculated on the basis of other measurement data collected by the controller 99, such as outdoor air temperature.

Furthermore, the data measurement unit 9 may be configured to measure the temperature of stored hot water in the hot water storage tank 1 at a plurality of locations, or measure a flow rate of secondary side hot water flowing through a pipe as shown in FIG. 1 or water temperatures before and after heating at the heat exchange unit 8, whereby hot water supply load data is allowed to be calculated by the hot water supply load data calculation unit 10 on the basis of a further accurate calculation formula.

(Hot Water Supply Load Data Calculation Unit 10)

The hot water supply load data calculation unit 10 calculates an amount of heat supplied from the hot water storage tank 1 to a hot water supply, on the basis of the data measured by the data measurement unit 9. In the following, a result of the calculation is also referred to as hot water supply load data.

The hot water supply load data calculation unit 10 calculates an amount of heat supplied from the hot water storage tank 1 to the hot water supply, at a predetermined time interval. The predetermined time interval may be determined in accordance with a time interval required for hot water supply load analysis at the hot water supply load data analysis unit 6. The predetermined time interval may be the same as the time interval for the hot water supply load analysis, but is desirably shorter than the time interval for the hot water supply load analysis. Alternatively, the predetermined time interval may be allowed to be set or changed by providing input means to the hot water supply system 100.

Hereinafter, as an example, a method of calculating an amount of heat supplied from the hot water storage tank 1 to the hot water supply and obtaining hot water supply load data will be described with, as an example, the case where the value of the predetermined time interval is 30 minutes.

As a specific method of calculating an amount of heat (a later-described amount of supplied heat Q) supplied from the hot water storage tank 1 to the hot water supply, the amount of supplied heat Q may be calculated on the basis of the following formula using the hot water supply temperature T1 and the hot water flow rate W1 of hot water supplied from the hot water storage tank 1 to the hot water supply and the water temperature T2 of the tap water supplied to the hot water storage tank 1.

$$Q=(T1-T2)\times W1$$

In the above formula, the description of unit conversion and constant multiplication is omitted. In addition, in the case where the data measurement unit 9 measures data other than the hot water supply temperature T1, the hot water flow rate W1, and the water temperature T2, hot water supply load data may be calculated on the basis of another calculation formula using these measurement data.

In the case where the measuring cycles at the data measurement unit 9 are 1 minute and the predetermined time interval is 30 minutes, values in the 1-minute cycle calculated using the measurement data may be added up for 30 minutes. In other words, a hot water supply load total sum obtained by adding up the values of the amount of supplied heat in each 1-minute cycle is calculated as hot water supply load data.

(Hot Water Supply Load Data Storage Unit 3)

The hot water supply load data storage unit 3 stores hot water supply load data calculated by the data measurement unit 9, the hot water supply load data calculation unit 10, the hot water supply load data analysis unit 6, the operation plan generation unit 4, and the operation plan correction unit 5. For example, the hot water supply load data storage unit 3 stores hot water supply load data for a predetermined time period (e.g., for 1 day) calculated by the hot water supply load data calculation unit 10, for a plurality of predetermined time periods (for a plurality of days, e.g., for 100 days).

In the present embodiment, a description will be given on the assumption that the hot water supply load data storage unit 3 has stored hot water supply load data for a plurality of days. In addition, the hot water supply load data storage unit 3 may also store measurement data measured by the data measurement unit 9.

(Hot Water Supply Load Data Analysis Unit 6)

The hot water supply load data analysis unit 6 classifies the hot water supply load data for the plurality of days stored in the hot water supply load data storage unit 3, into a plurality of groups on the basis of a time slot at which the hot water supply load is maximum. The analysis result of the hot water supply load data analysis unit 6 is stored in the hot water supply load data storage unit 3. In the following, each classified group is also referred to as a cluster. A method of generating clusters by the hot water supply load data analysis unit 6 will be described with reference to FIG. 3 described later.

(Operation Plan Generation Unit 4)

The operation plan generation unit 4 predicts a hot water supply load for the next day on the basis of the analysis result of the hot water supply load data analysis unit 6 once a day, and generates an operation plan for the boiling unit 2 on the basis of a result of the prediction. Specifically, the operation plan generation unit 4 makes planning for 24 hours regarding boiling of the boiling unit 2 to be performed from what time for what minutes with what instruction value (e.g., the frequency or output of a heat pump). For the sake of convenience, the operation plan generation unit 4 has been described to predict a hot water supply load for the next day, but is not limited thereto. For example, the operation plan generation unit 4 may perform prediction and planning for 24 hours from 3 a.m. at the day of control to be performed for the boiling unit 2 to 3 a.m. at the next day, at 1 a.m., 2 a.m., or the like in the day. The operation plan generated by the operation plan generation unit 4 is stored in the hot water supply load data storage unit 3.

(Operation Plan Correction Unit 5)

The operation plan correction unit 5 reviews the operation plan generated by the operation plan generation unit 4, on the basis of a hot water supply load result. Specifically, the operation plan correction unit 5 reviews the operation plan generated by the operation plan generation unit 4 every predetermined time, on the basis of a hot water supply load result. In the present embodiment, a description will be given with, as an example, the case where the predetermined time is three hours, but the predetermined time is not limited thereto. The operation plan reviewed by the operation plan correction unit 5 is stored in the hot water supply load data storage unit 3.

Here, when the operation plan correction unit 5 has already performed reviewing, the already reviewed operation plan is referred to as a corrected plan. When the corrected plan is present, the operation plan correction unit 5 does not keep execution of the corrected plan, and reviews the contents of the corrected plan again.

(Boiling Operation Unit 7)

The boiling operation unit 7 controls an amount of boiling at the boiling unit 2, on the basis of the corrected plan generated by the operation plan correction unit 5. An amount of heat generated through boiling by the boiling operation unit 7 in three hours is an amount for a predicted hot water supply load for the three hours. Therefore, as in a case such as the case where a hot water supply load occurs in the middle of boiling by the boiling operation unit 7, a boiling time planned in the operation plan or the corrected plan may be different from a time of boiling performed actually at the time of control.

In addition, for example, when the temperature of the stored hot water in the hot water storage tank 1 and the temperature of the primary side hot water from the boiling unit 2 have been close to each other, there is almost no heat exchange by the heat exchange unit 8. In such a case, even when the corrected plan indicates operation, operation of the boiling unit 2 is stopped.

Boiling for the amount of heat that is scheduled to be generated through boiling in the three hours but has not been sufficiently generated through boiling due to stop of the boiling operation unit 7 may be restarted when heat exchange is made possible at predetermined efficiency or higher.

Moreover, when the remaining amount of stored hot water has reached a lower limit, even if the corrected plan indicates stop, operation of the boiling unit 2 may be restarted. In general, in order to avoid hot water shortage of the hot water storage tank 1, a backup heater is provided on a pipe portion or in the hot water storage tank 1 in many cases. As setting of the predetermined lower limit for the remaining amount of stored hot water, the predetermined lower limit is set in consideration of a start condition for the backup heater, and thus it is possible to improve the energy saving property.

[Operation of Hot Water Supply Load Data Analysis Unit 6]

Figure 3:
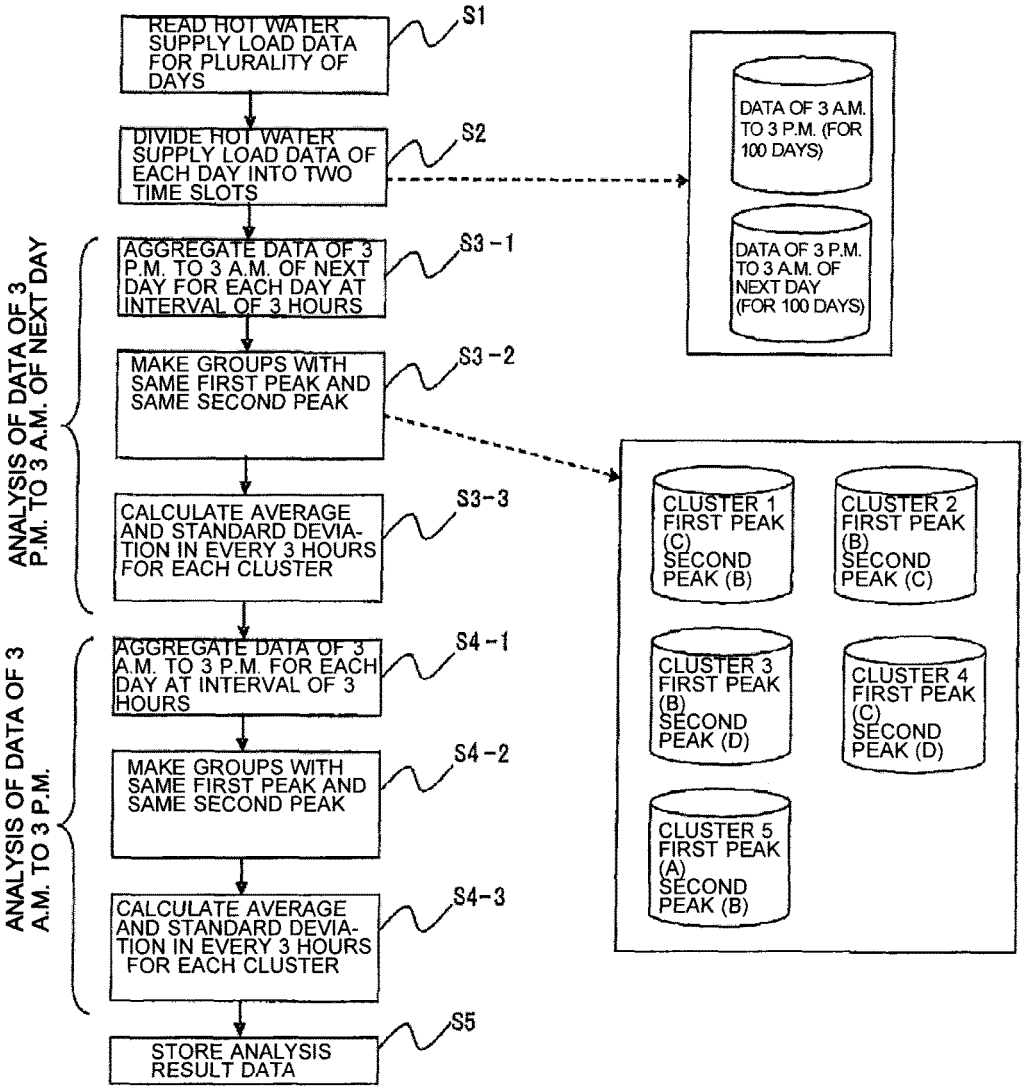
FIG. 3 is a flowchart showing flow of a process of a hot water supply load data analysis unit shown in FIG. 2.
Figure 4:
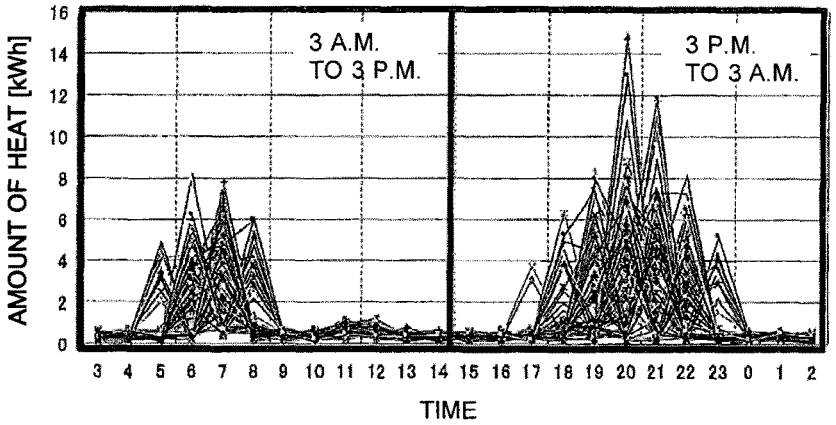
FIG. 4 is an example of a simulation result of a hot water supply load every hour.
Figure 5:
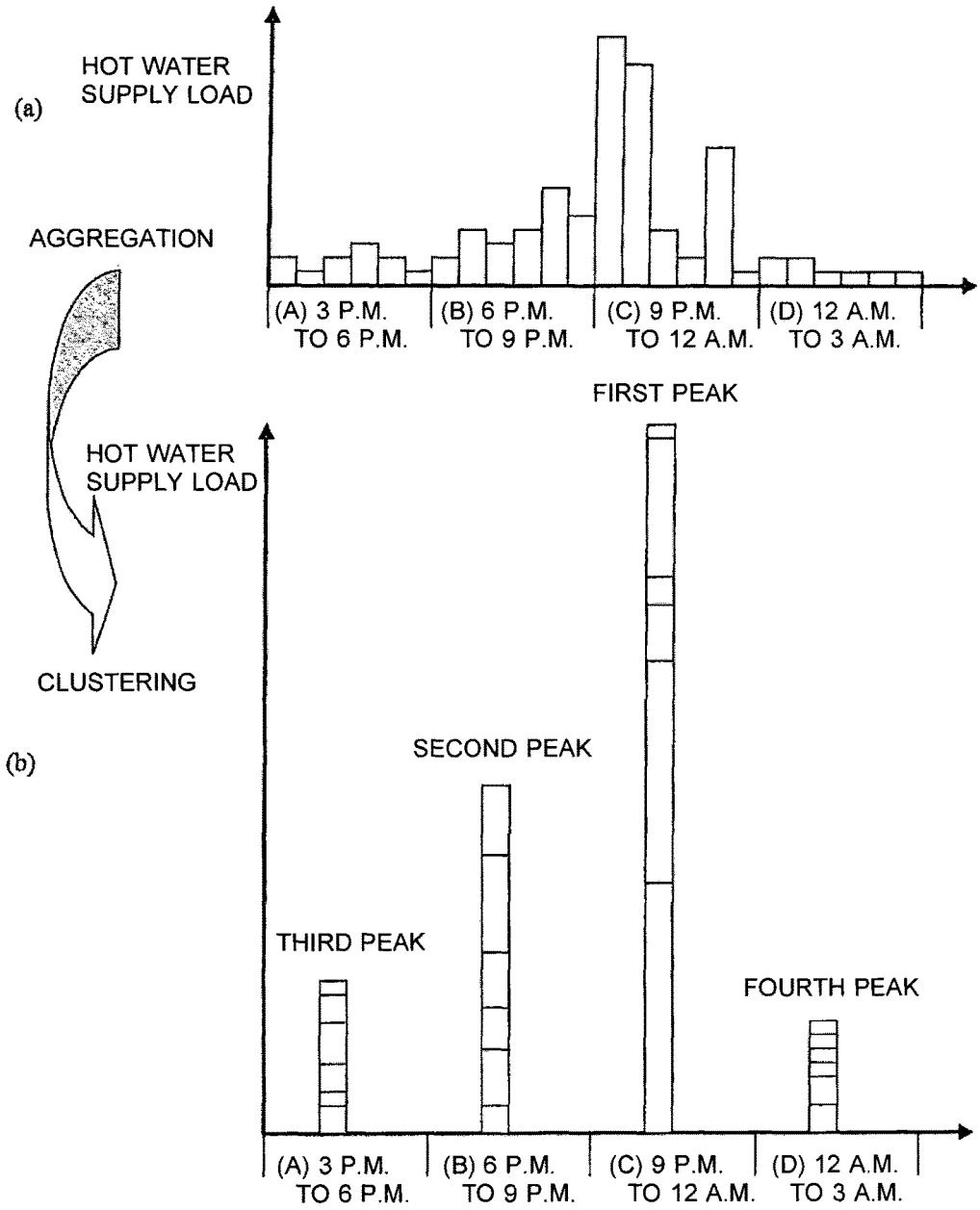
FIG. 5 is an example of an aggregation of hot water supply load data.
Figure 6:
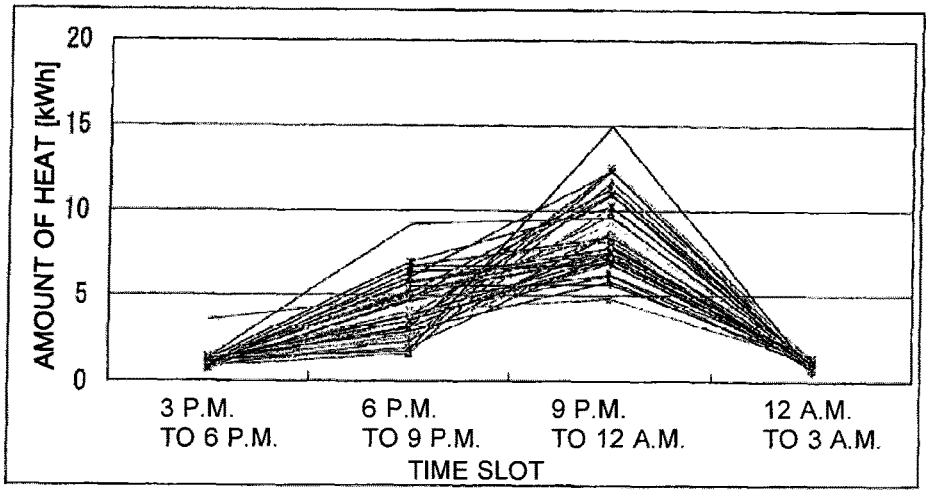
FIG. 6 is an example of a simulation result of clustering.
Figure 6:
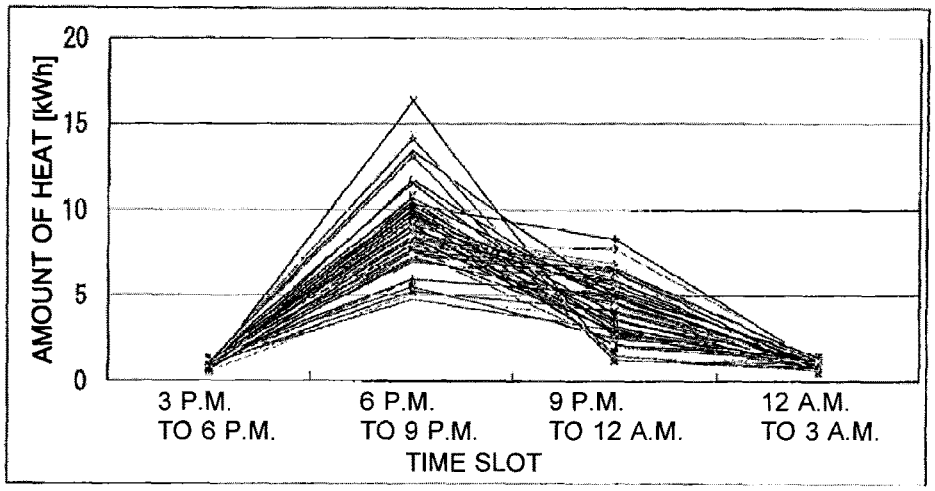

FIG. 3 is a flowchart showing flow of a process of the hot water supply load data analysis unit 6 shown in FIG. 2. FIG. 4 is an example of a simulation result of a hot water supply load every hour. FIG. 5 is an example of an aggregation of hot water supply load data. FIG. 6 is an example of a simulation result of clustering.

FIG. 5(*a*) shows an aggregation result of hot water supply load data, and FIG. 5(*b*) is a result obtained by clustering the aggregation result as described later. FIG. 6(*a*) is a simulation result of a cluster with a first peak (C) and a second peak (B), and FIG. 6(*b*) is a simulation result of a cluster with a first peak (B) and a second peak (C) in FIG. 8.

Operation of the hot water supply load data analysis unit 6 and the like will be described with reference to FIGS. 3 to 6.

(Step S1)

The hot water supply load data analysis unit 6 reads the hot water supply load data for the plurality of days stored in the hot water supply load data storage unit 3.

(Step S2)

The hot water supply load data analysis unit 6 divides the hot water supply load data of each day read in step S1, into two time slots.

In the present embodiment, the case will be described in which 3 a.m., at which it is thought that almost no hot water supply load generally occurs in a standard household, and 3 p.m., which is 12 hours later and at which it is thought that a hot water supply load is relatively low in a day, are set as division times.

Specifically, the hot water supply load data analysis unit 6 divides the hot water supply load at each day into a hot water supply load at 3 a.m. to 3 p.m. and a hot water supply load at 3 p.m. to 3 a.m. of the next day. Thus, in FIG. 3, "data of 3 a.m. to 3 p.m. (for 100 days)" and "data of 3 p.m. to 3 a.m. of the next day (for 100 days)" are described.

FIG. 4 is an example of a simulation result of hot water supply loads for 100 days under a predetermined condition. Also from this result, it is indicated that it is preferred to divide the hot water supply load into a hot water supply load at 3 a.m. to 3 p.m. and a hot water supply load at 3 p.m. to 3 a.m. of the next day, but the present invention is not limited thereto, and other times may be set depending on the state of a household to which the hot water supply system 100 is introduced.

As described above, the hot water supply load data analysis unit 6 divides the hot water supply load data and analyzes each divided data. In the following, a description of analysis of "hot water supply load at 3 a.m. to 3 p.m." is omitted, and analysis of "hot water supply load at 3 p.m. to 3 a.m. of the next day" will be described.

(Step S3-1)

The hot water supply load data analysis unit 6 aggregates the data of 3 p.m. to 3 a.m. of the next day for each day divided in step S2, at a predetermined analysis time interval. In the following, a description will be given on the assumption that, as an example, the predetermined analysis time interval is set as three hours.

First, the hot water supply load data analysis unit 6 adds up hot water supply load data for three hours measured in 30-minute unit by the hot water supply load data calculation unit 10. Since the predetermined analysis time interval is three hours, the hot water supply load data analysis unit 6 divides 12 hours of 3 p.m. to 3 a.m. of the next day into four time slots, (A) 3 p.m. to 6 p.m., (B) 6 p.m. to 9 p.m., (C) 9 p.m. to 12 and (D) 12 a.m. to 3 a.m. In other words, the hot water supply load data analysis unit 6 adds up the hot water load data for three hours measured in 30-minute unit by the hot water supply load data calculation unit 10, in the four time slots (A) to (D) (the state of FIG. 5(*a*)).

(Step S3-2)

In three-hour unit, the maximum hot water supply load is referred to as a first peak, the time slot thereof is referred to as a first peak time slot, the second highest hot water supply load is referred to as a second peak, and the time slot thereof is referred to as a second peak time slot. For example, if a hot water supply load at a certain day is "(A) 5 kWh, (B) 10 kWh, (C) 20 kWh, and (D) 3 kWh" in the respective time slots (A) to (D), the first peak time slot is (C), the second peak time slot is (B); and if the hot water supply load is "(A) 5 kWh, (B) 20 kWh, (C) 10 kWh, and (D) 3 kWh", the first peak time slot is (B), and the second peak time slot is (C).

In step S3-2, the hot water supply load data analysis unit 6 groups the data aggregated in step S3-1 into groups each having the same first peak time slot and the same second peak time slot (clustering). The data aggregated in step S3-1 is data for every 30 minutes in the respective time slots (A) to (D).

For example, the afternoon hot water supply loads for 100 days are grouped as follows.

Cluster 1: first peak (C), second peak (B), occurrence frequency 50% (50 days out of 100 days)

Cluster 2: first peak (B), second peak (D), occurrence frequency 30% (30 days out of 100 days)

Cluster 3: first peak (B), second peak (D), occurrence frequency 10% (10 days out of 100 days)

Cluster 4: first peak (C), second peak (D), occurrence frequency 8% (8 days out of 100 days)

Cluster 5: first peak (A), second peak (B), occurrence frequency 2% (2 days out of 100 days)

In addition, as shown in FIGS. 6(*a*) and 6(*b*), hot water supply load data (a simulation result) classified into cluster 1 and cluster 2 is shown as an example.

The hot water supply load data in FIG. 6(*a*) is a simulation result that is grouped into a cluster with a first peak (C) and a second peak (B) as a result of analysis by the hot water supply load data analysis unit 6.

Moreover, FIG. 6(*b*) is a simulation result that is grouped into a cluster with a first peak (B) and a second peak (C) as a result of analysis by the hot water supply load data analysis unit 6.

(Step S3-3)

The hot water supply load data analysis unit 6 obtains the average and the standard deviation of the hot water supply loads in each time slot (three hours) for each cluster in step S3-2. These data is statistical data used by the operation plan generation unit 4 and the operation plan correction unit 5.

(Step S4-1) to (Step S4-3)

In steps S3-1 to S3-3, the hot water supply load data analysis unit 6 performs calculation on the data of 3 p.m. to 3 a.m. of the next day for each day divided in step S2.

In steps S4-1 to S4-3, the hot water supply load data analysis unit 6 performs calculation corresponding to steps S3-1 to S3-3, on the data of 3 a.m. to 3 p.m. for each day divided in step S2.

(Step S5)

The hot water supply load data analysis unit 6 stores the analysis result and the like from steps S1 to S4-3 in the hot water supply load data storage unit 3.

In the analysis method in steps S3-2 and S4-2, clustering is performed with focus on the first peak and the second peak, but clustering may be performed with focus on only the first peak, or clustering may be performed also with focus on a third peak and a fourth peak.

For example, in a household in which a daily life pattern almost does not change, a result is produced that a very high first peak (hot water supply load) occurs in the same time slot every day, and the difference among hot water supply load amounts of the second peak to the fourth peak is small. In such a case, it is not particularly necessary to take the second peak into consideration, and clustering may be performed with focus on only the first peak.

Furthermore, as the analysis method in steps S1 to S4-3, the analysis method has been described in which data for a plurality of days stored in the hot water supply load data storage unit 3 is not particularly distinguished based on day, but the analysis method is not limited thereto. For example, the data may be previously divided into different groups for days such as weekdays and holidays, before being analyzed.

By so doing, it is possible to perform data analysis on only data of past weekdays when the next day is a weekday, and to perform data analysis on only data of past holidays if the next day is a holiday, and thus it is possible to perform more appropriate data analysis.

In addition, the hot water supply load data analysis unit 6 has been described, as an example, with the predetermined analysis time interval being set as three hours, but the predetermined analysis time interval is not limited thereto. For example, when an analysis target is 3 a.m. to 3 p.m., the 12 hours may be divided to "(A) 3 a.m. to 6 a.m., (B) 6 a.m. to 10 a.m. (four hours), (C) 10 a.m. to 1 p.m., and (D) 1 p.m. to 3 p.m. (two hours)".

By so doing, one-hours immediately before and after 12 p.m. during which preparation and cleaning for lunch occur are assigned to the same time slot (C), more appropriate clustering for the operation plan generation unit 4 may be performed. From the point of view that time periods immediately before and after 12 p.m. are assigned to the same time slot, times for dividing 1 day may not be 3 a.m. and 3 p.m. and may be other times.

It is possible to handle either case if the time unit, the times, and the like that are exemplified in the description of the hot water supply load data analysis unit 6 and the hot water supply load data storage unit 3 are changed. By providing input means to the hot water supply system 100, a user, an installer, or the like also may be allowed to set or change the setting values of these various setting items.

[Operation of Operation Plan Generation Unit 4]

Figure 7:
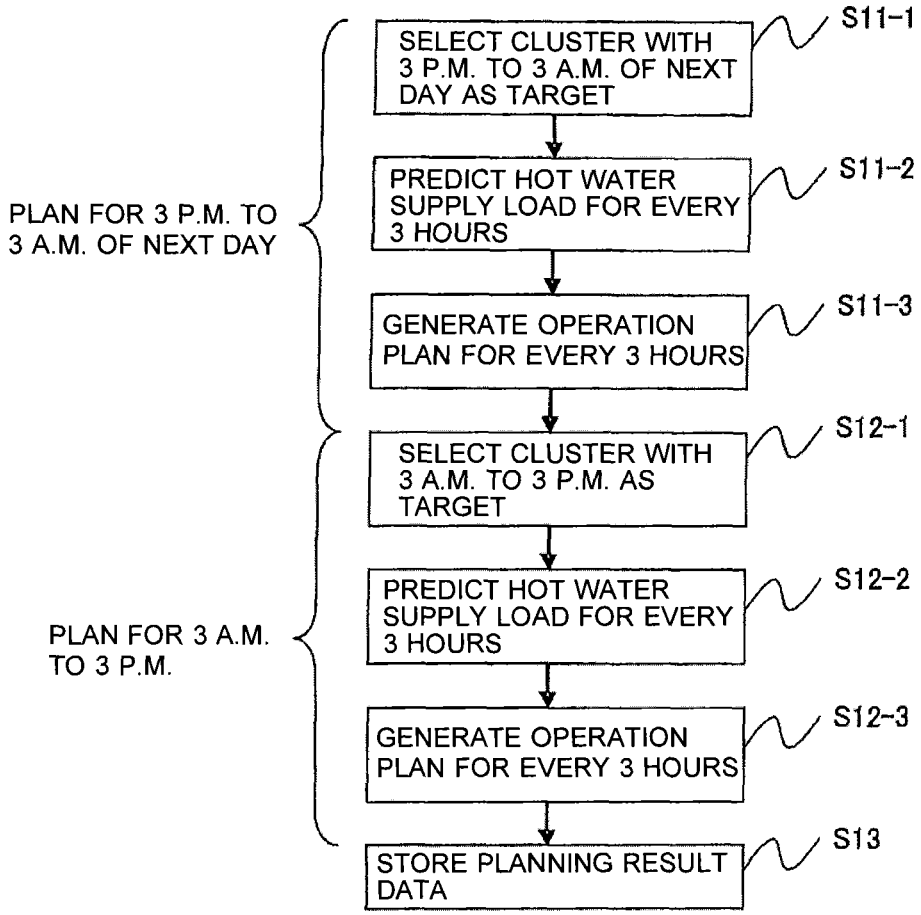
FIG. 7 is a flowchart showing flow of a process of an operation plan generation unit.
Figure 8:
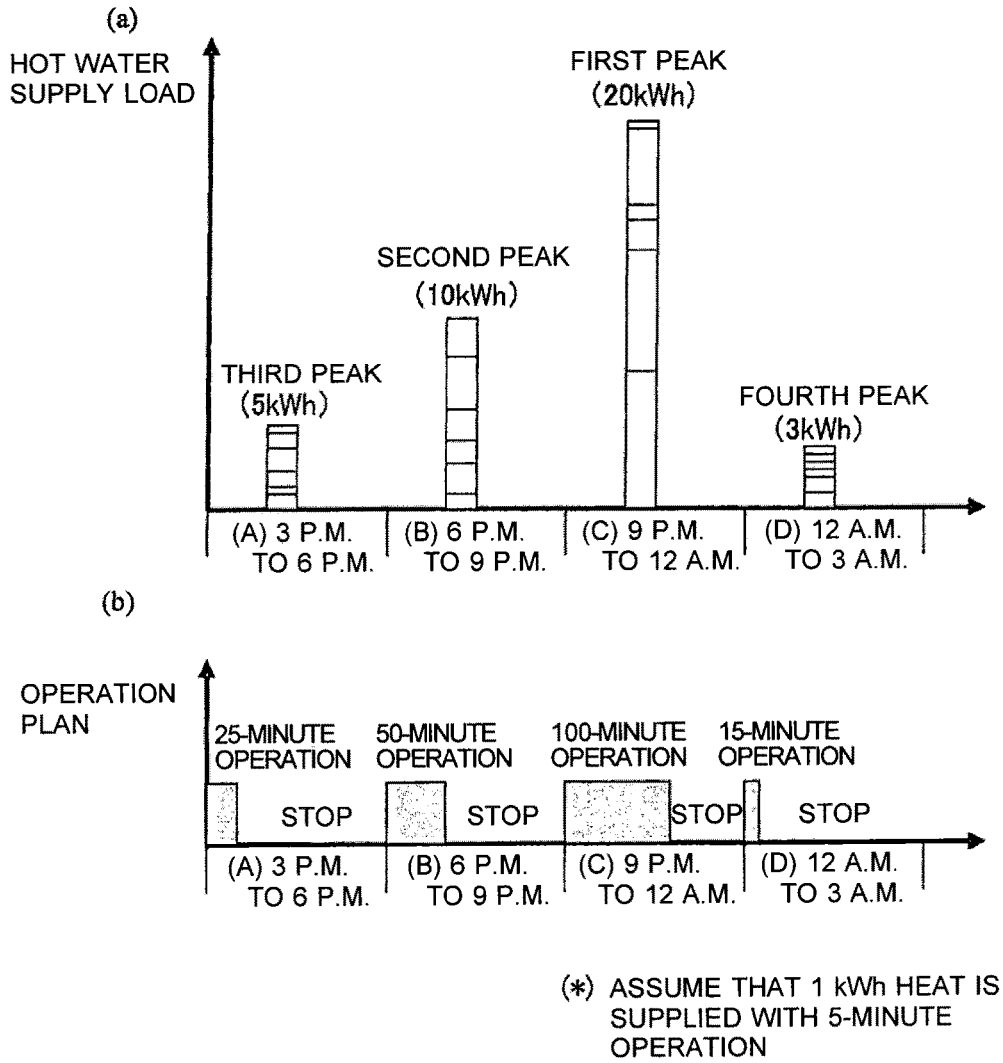
FIG. 8 is an image of an operation plan.

FIG. 7 is a flowchart showing flow of a process of the operation plan generation unit 4. FIG. 8 is an image of an operation plan. An operation of the operation plan generation unit 4 and the like will be described with reference to FIGS. 7 and 8.

The above-described operation of the hot water supply load data analysis unit 6 is roughly divided tin to "3 a.m. to 3 p.m. (steps S4-1 to S4-3) and "3 p.m. to 3 a.m. of the next day (step S3-1 to S3-3)", and an operation of the operation plan generation unit 4 is also roughly divided into "3 a.m. to 3 p.m. (steps S12-1 to S12-3) and "3 p.m. to 3 a.m. of the next day (step S11-1 to S11-3)".

(Step S11-1)

The operation plan generation unit 4 selects one of a plurality of clusters (target: 3 p.m. to 3 a.m. of the next day) generated by the hot water supply load data analysis unit 6. As a criterion of the selection, a cluster having the maximum occurrence frequency may be selected, or a cluster having the maximum occurrence frequency may be selected from the clusters each having a first peak in the earliest time slot. The latter is a selection method for decreasing a possibility that a risk of hot water shortage occurs. In the example of the classification into clusters 1 to 5, which is described in the description of the hot water supply load data analysis unit 6, cluster 1 is selected in the former selection method, and cluster 2 is selected in the latter selection method.

A cluster having a low occurrence frequency is regarded as an exceptional hot water supply load pattern and may be excluded from the target clusters. For example, in the case of being divided into clusters 1 to 5 as described in the description of the operation of the hot water supply load data analysis unit 6, cluster 5, which has an occurrence frequency of 5% or lower, may be excluded.

(Step S11-2)

The operation plan generation unit 4 predicts a hot water supply load for every three hours in the next day for the cluster selected in step S11-2. In the present embodiment, for example, a method of predicting a hot water supply load by calculating "hot water supply load prediction=average+standard deviation×adjustment coefficient" using the average and the standard deviation for each three hours calculated by the hot water supply load data analysis unit 6, is used. Here, the adjustment coefficient is a setting parameter introduced for avoiding a risk of hot water shortage, and is set, for example, as 1.0, 1.5, or the like.

(Step S11-3)

The operation plan generation unit 4 generates an operation plan for every three hours for the boiling unit 2 such that a predicted hot water supply load for every three hours which has been predicted in step S11-2 is to be supplied.

For example, it is assumed that the predicted hot water supply load for 3 p.m. to 3 a.m. of the next day, "(A) 3 p.m. to 6 p.m., (B) 6 p.m. to 9 p.m., (C) 9 p.m. to 12 a.m., and (D) 12 a.m. to 3 a.m.", is "(A) 5 kWh, (B) 10 kWh, (C) 20 kWh, and (D) 3 kWh" (see FIG. 8(*a*)). The operation plans in this case are as follows. The following (A) to (D) show operation plans corresponding to the above time slots.

(A) Start boiling at 3 p.m. and stop boiling at the time when heat of 5 kWh has been supplied.

(B) Start boiling at 6 p.m. and stop boiling at the time when heat of 10 kWh has been supplied.

(C) Start boiling at 9 p.m. and stop boiling at the time when heat of 20 kWh has been supplied.

(D) Start boiling at 12 a.m. and stop boiling at the time when heat of 3 kWh has been supplied.

Here, how long boiling is required is determined by the previously provided characteristics of the boiling unit 2. For example, when the boiling unit 2 of the hot water supply system 100 is a heat source that requires boiling for 5 minutes to supply heat of 1 kWh, an operation plan is as follows.

(A) 3 p.m. to 3:25 p.m.: operate (5 kWh heat supplied)
3:25 p.m. to 6 p.m.: stop (B) 6 p.m. to 6:50 p.m.: operate (10 kWh heat supplied)
6:50 p.m. to 9 p.m.: stop (C) 9 p.m. to 10:40 p.m.: operate (20 kWh heat supplied)
10:40 p.m. to 12 a.m.: stop (D) 12 a.m. to 12:15 a.m.: operate (3 kWh heat supplied)
12:15 a.m. to 3 a.m.: stop A command value to the boiling unit 2 does not need to be constant. In other words, an amount of heat to be generated by the boiling unit 2 may be varied. For example, to supply an amount of heat equivalent to 10 kWh at 6 p.m. to 6:50 p.m. as described above, a command value may be varied in accordance with the characteristics of the boiling unit 2.

In addition, in step S11-3, the operation plan generation unit 4 makes planning such that, for a predicted hot water supply load for each time slot (every three hours), boiling is to be performed in the predicted time slot, in order to avoid heat radiation loss as much as possible. For example, as shown in FIG. 8(*b*), in the time slot (A), boiling is performed for 25 minutes, and it means that this boiling is planned to be performed within the time slot (A).

Furthermore, in step S11-3, as shown in FIG. 8(*b*), the operation plan generation unit 4 performs boiling at the beginning of each time slot in order to avoid hot water shortage as much as possible.

(Step S12-1) to (Step S12-3)

In steps S11-1 to S11-3, the operation plan generation unit 4 generates an operation plan for data of 3 a.m. of the next day.

In steps S12-1 to S12-3, the operation plan generation unit 4 performs a process corresponding to steps S11-1 to S11-3, for data of 3 a.m. to 3 p.m. to generate an operation plan.

(Step S13)

The operation plan generation unit 4 stores the respective operation plans generated in steps S11-1 to S11-3 and steps S12-2 to S12-3, in the hot water supply load data storage unit 3.

[Operation of Operation Plan Correction Unit 5]

Figures 9, 10:
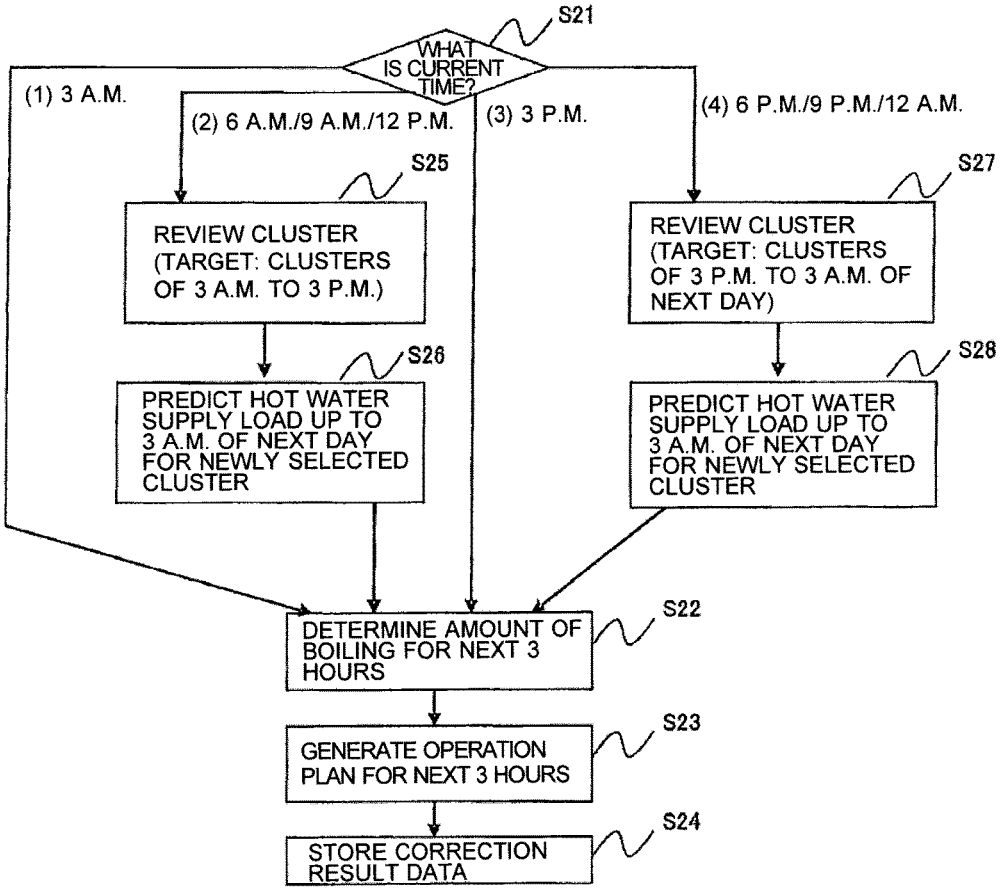
FIG. 9 is a flowchart showing flow of a process of an operation plan correction unit.
FIG. 10 is an example of a cluster review method.

FIG. 9 is a flowchart showing flow of a process of the operation plan correction unit 5. FIG. 10 is an example of a cluster review method. An operation of the operation plan correction unit 5 and the like will be described with reference to FIGS. 9 and 10.

(Step S21)

The operation plan correction unit 5 determines whether the current time is any of the following (1) to (4): (1) 3 a.m., (2) 6 a.m., 9 a.m., or 12 p.m., (3) 3 p.m., and (4) 6 p.m., 9 p.m., or 12 a.m.

If the operation plan correction unit 5 determines that it is (1) 3 a.m., the operation plan correction unit 5 proceeds to step S22 where an amount of heat to be generated through boiling in hours is determined.

If the operation plan correction unit 5 determines that it is (2) 6 a.m., 9 a.m., or 12 p.m., the operation plan correction unit 5 proceeds to step S25.

If the operation plan correction unit 5 determines that it is (3) 3 p.m., the operation plan correction unit 5 proceeds to step S22 where an amount of heat to be generated through boiling in three hours is determined.

If the operation plan correction unit 5 determines that it is (4) 6 p.m., 9 p.m., or 12 a.m., the operation plan correction unit 5 proceeds to step S27 where review of a selected cluster is performed.

(Step S22)

The operation plan correction unit 5 determines an amount of heat Q to be generated through boiling in the next three hours, and proceeds to step S23. The operation plan correction unit 5 executes a method of determining an amount of heat Q to be generated through boiling in the next three hours, as follows.

Q1, Q0, and Q_base are defined as follows.

When the current time is 3 a.m., an amount of heat for 3 a.m. to 6 a.m. planned by the operation plan generation unit 4 is defined as Q1; when the current time is 6 a.m., 9 a.m., or 12 p.m., a hot water supply load prediction for the next three hours predicted in step S26 described later is defined as Q1; when the current time is 3 p.m., an amount of heat for 3 p.m. to 6 p.m. planned by the operation plan generation unit 4 is defined as Q1; and when the current time is 6 p.m., 9 p.m., or 12 a.m., a hot water supply load prediction for the next three hours predicted in step S28 described later is defined as Q1. In addition, a currently remaining amount of stored hot water is defined as Q0. Furthermore, an amount of heat that is desired to remain in the hot water storage tank 1 at execution of review of the operation plan in order to reduce a risk of hot water shortage is defined as a base remaining amount of stored hot water Q_base.

At that time, the amount of heat Q to be generated through boiling in the next three hours is provided by the following formula using the base remaining amount of stored hot water Q_base.

$$Q=(Q_base-Q0)+Q1$$

It should be noted that if the result Q of calculation of the above formula is a negative value, it is set that Q=0.

As described above, in step S22, the operation plan correction unit 5 determines the amount of heat Q to be generated through boiling in the next three hours.

As described above, in step S22, it is possible to absorb the error between a result and a prediction of the hot water supply load in the immediately previous three hours by adding a difference from the base remaining amount of stored hot water Q_base at the time of execution of correction to the amount of boiling for the next three hours.

In other words, if the hot water supply load result falls below the predicted operation plan, the boiling unit 2 is controlled by the controller 99 such that an amount of heat generated by the boiling unit 2 in each time slot in the predicted operation plan is reduced. In addition, if the hot water supply load result exceeds the predicted operation plan, the boiling unit 2 is controlled by the controller 99 such that an amount of heat generated by the boiling unit 2 in each time slot in the predicted operation plan is increased.

It should be noted that if the result and the prediction of the hot water supply load for the next three hours coincide with each other, the remaining amount of stored hot water at the time after three hours coincides with the base remaining amount of stored hot water Q_base.

(Step S23)

The operation plan correction unit 5 generates a corrected plan for the amount of heat Q to be generated through boiling in the next three hours, and proceeds to step S23. In the corrected plan, boiling is started at the current time, and is stopped at a time when boiling for the amount of heat Q is completed.

In step S23, the cluster is newly changed when shifting from step S26 or step S28.

(Step S24)

The operation plan correction unit 5 stores the corrected plan generated in step S23, in the hot water supply load data storage unit 3.

(Step S25)

The operation plan correction unit 5 reviews the selected cluster. Here, prior to the description of step S25 and step S26 described later, the case where the current time is 9 a.m. will be described as an example. It should be noted that the idea is also the same when it is 6 a.m. or 12 p.m.

The operation plan correction unit 5 determines a cluster to be newly selected, for example, by the following procedure. First, the operation plan correction unit 5 aggregates hot water supply load results from 3 a.m. to the current time (9 a.m.) for every three hours. Next, the operation plan correction unit 5 calculates a square error between the aggregated load result and the average hot water supply load for each three hours in each cluster. Then, the operation plan correction unit 5 newly selects the cluster having the minimum sum of the square errors from among all the clusters. A specific example of the method of determining a cluster to be newly selected in step S25 will be described with step S27 described later.

(Step S26)

The operation plan correction unit 5 predicts a hot water supply load for the next three hours (9 a.m. to 12 p.m.) for the newly selected cluster. Here, prior to the description of step S26 and step S27 described later, the case where the current time is 9 p.m. will be described as an example. It should be noted that the idea is also the same when it is 6 p.m. and 12 a.m.

In the present embodiment, a method of predicting a hot water supply load by the operation plan correction unit 5 is the same as the prediction method in the operation plan generation unit 4. In other words, the operation plan correction unit 5 predicts a hot water supply load by calculating "hot water supply load prediction=average+standard deviation×adjustment coefficient" using the average and the standard deviation of the hot water supply loads for each three hours.

(Step S27)

The operation plan correction unit 5 reviews the selected cluster.

The operation plan correction unit 5 determines a cluster to be newly selected, for example, by the same procedure as the procedure in step S25.

First, the operation plan correction unit 5 aggregates hot water supply load results from 3 p.m. to the current time (9 p.m.) for every three hours.

Next, the operation plan correction unit 5 calculates a square error between the aggregated load result and the average hot water supply load for each three hours in each cluster.

Then, the operation plan correction unit 5 selects the cluster having the minimum sum of the square errors from among all the clusters.

Here, a method of determining a cluster by the operation plan correction unit 5 will be specifically described with reference to FIG. 10.

First, since the current time is 9 p.m., the operation plan correction unit 5 aggregates load results in 3 p.m. to 6 p.m. and in 6 p.m. to 9 p.m. It should be noted that the load result in 3 p.m. to 6 p.m. is "3", and the load result in 6 p.m. to 9 p.m. is "12".

Next, the operation plan correction unit 5 calculates a square error between the load result in 3 p.m. to 6 p.m. and the average hot water supply load in 3 p.m. to 6 p.m. in each cluster generated by clustering performed in step S3-2. Similarly, the operation plan correction unit 5 calculates a square error between the load result in 6 p.m. to 9 p.m. and the average hot water supply load in 6 p.m. to 9 p.m. in each cluster. It should be noted that in the example of the description of FIG. 10, the case where clusters 1 to 3 are generated in total by clustering in step S3-2 is described as an example.

Then, since the sum of the square errors of cluster 1 is the minimum among clusters 1 to 3, the operation plan correction unit 5 newly selects cluster 1.

In the present embodiment, the operation plan correction unit 5 has been described as one performing processing based on square errors in steps S25 and S27, but is not limited thereto and may use the absolute value of an error or the like.

In addition, a cluster to be selected may be determined using square errors that have been multiplied by a weighting factor that is settable for each cluster, not using square errors as they are. For example, for the currently selected cluster, the maximum weight is used for multiplication, so that the currently selected cluster is preferentially selected, or a weighting factor corresponding to the occurrence frequency of each cluster may be used for multiplication.

Furthermore, in the case of prediction as a cluster having a first peak in the immediately previous three hours, if the hot water supply load result is within the range of the average in the predicted cluster±standard deviation, review of the cluster may not be performed.

(Step S28)

The operation plan correction unit 5 predicts a hot water supply load for the next three hours (9 a.m. to 12 p.m.) for the newly selected cluster.

In the present embodiment, a method of predicting a hot water supply load by the operation plan correction unit 5 is the same as the prediction method in the operation plan generation unit 4. In other words, the operation plan correction unit 5 predicts a hot water supply load by calculating "hot water supply load prediction=average+standard deviation×adjustment coefficient" using the average and the standard deviation of the hot water supply loads for each three hours.

(Others)

In Embodiment 1, 1 day is divided into two analysis time slots and analysis, planning, and correction are individually performed for the two analysis time slots (see FIG. 4), but 1 day may not be divided.

[Modification]

Figure 11:
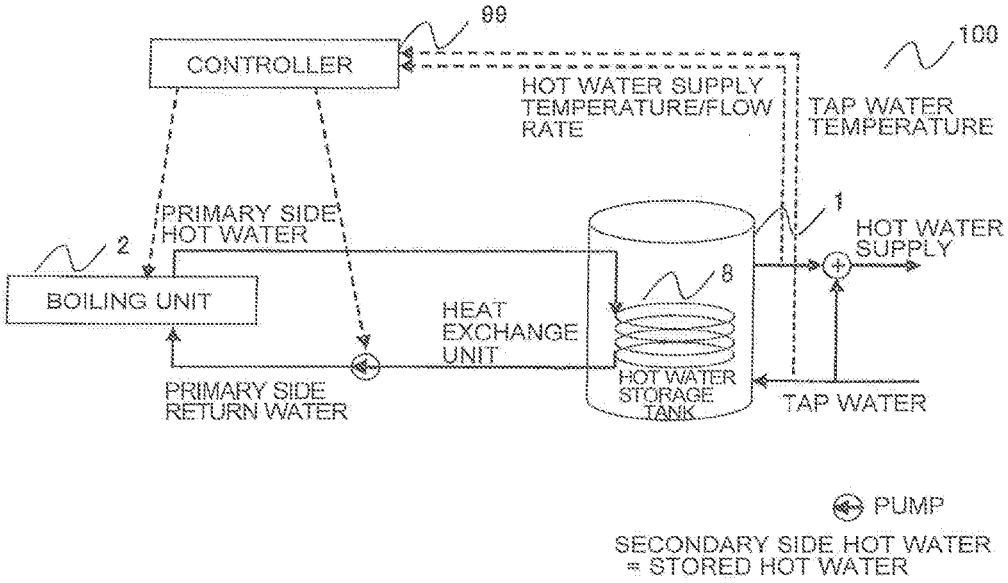
FIG. 11 is a modification of the hot water supply system according to Embodiment 1 of the present invention.

FIG. 11 is a modification of the hot water supply system 100 according to Embodiment 1. In this configuration, the heat exchange unit 8 is installed within the hot water storage tank 1. The heat exchange unit 8 is, for example, a heat transfer coil or the like. In the case of the configuration of FIG. 11, unlike the configuration shown in FIG. 1, it is unnecessary to provide a pipe and a pump for secondary side hot water. Even with the configuration of FIG. 11, it is possible to obtain the same advantageous effects as those of the hot water supply system 100 shown in FIG. 1.

Advantageous Effects of Hot Water Supply System 100 According to Embodiment 1

In the hot water supply system 100 according to Embodiment 1, the hot water supply load data analysis unit 6 performs clustering through characteristics analysis of past hot water supply load data (step S3-2, step S4-2), the operation plan generation unit 4 generates an operation plan composed of a hot water supply load pattern that is typical for the user (steps S11-1 to S13), and the operation plan correction unit 5 changes the generated operation plan (steps S22, S23, and S25 to S28).

Due to this, when the hot water supply load result at the day of control by the controller 99 is a hot water supply load pattern that is classified into the selected cluster, it is possible to achieve energy saving by an operation according to an operation plan based on a hot water supply load prediction whose prediction accuracy is high.

In addition, even when the hot water supply load result at the day of control is not a hot water supply load pattern that is classified into the selected cluster, it is possible to achieve energy saving by an operation according to a corrected plan adjusted to the actual hot water supply load pattern.

Embodiment 2

In Embodiment 2, the difference from Embodiment 1 will be mainly described. In Embodiment 2, input means is provided such that an operation that aims at minimizing the running cost is selectable. In other words, in Embodiment 2, in the case where the electricity unit price is a price by time slot, an operation plan is made and changed in consideration of the electricity unit price, so that an operation that aims at minimizing the running cost is selectable.

A method of generating an operation plan, that is, [Operation of hot water supply load data analysis unit 6], is the same as in Embodiment 1.

Meanwhile, a boiling method for each three hours, that is, [Operation of operation plan generation unit 4], is different from that in Embodiment 1. In Embodiment 2, a boiling plan is corrected through the following procedure.

First, a plan for 3 a.m. to 6 a.m. is kept unchanged.

Next, a plan for 6 a.m. to 9 a.m. is changed.

If the electricity unit price for 6 a.m. to 9 a.m. is lower than or equal to the electricity unit price for 3 a.m. to 6 a.m., the plan is not changed.

If the electricity unit price for 6 a.m. to 9 a.m. is higher than the electricity unit price for 3 a.m. to 6 a.m., the plan is changed such that an amount of boiling that is originally planned for 6 a.m. to 9 a.m. is to be conducted in 3 a.m. to 6 a.m. Due to this, if the amount of boiling exceeds a maximum amount of boiling that is enabled in 3 a.m. to 6 a.m., an amount of boiling in 3 a.m. to 6 a.m. is set to the maximum amount of enabled boiling, and an amount of boiling obtained by subtracting the amount of boiling shifted to one for 3 a.m. to 6 a.m. from the amount of boiling originally planned for 6 a.m. to 9 a.m. is conducted in 6 a.m. to 9 a.m.

Next, a plan for 9 a.m. to 12 p.m. is changed.

If the electricity unit price for 9 a.m. to 12 p.m. is lower than or equal to each of the electricity unit price for 3 a.m. to 6 a.m. and the electricity unit price for 6 a.m. to 9 a.m., the plan is not changed.

If the electricity unit price for 9 a.m. to 12 p.m. is lower than the electricity unit price for 3 a.m. to 6 a.m. and higher than the electricity unit price for 6 a.m. to 9 a.m., the plan is changed such that an amount of boiling that is originally planned for 9 a.m. to 12 p.m. is to be conducted in 6 a.m. to 9 a.m. If, due to this, the amount of boiling exceeds a maximum amount of boiling that is enabled in 6 a.m. to 9 a.m., an amount of boiling in 6 a.m. to 9 a.m. is set to the maximum amount of enabled boiling, and an amount of boiling obtained by subtracting the amount of boiling shifted to one for 6 a.m. to 9 a.m. from the amount of boiling originally planned for 9 a.m. to 12 p.m. is conducted in 9 a.m. to 12 p.m.

If the electricity unit price for 9 a.m. to 12 p.m. is higher than the electricity unit price for the 3 a.m. to 6 a.m. and lower than the electricity unit price for the 6 a.m. to 9 a.m., the plan is changed such that the amount of boiling that is originally planned for 9 a.m. to 12 p.m. is to be conducted in 3 a.m. to 6 a.m. If, due to this, the amount of boiling exceeds the maximum amount of boiling that is enabled in 3 a.m. to 6 a.m., an amount of boiling in 3 a.m. to 6 a.m. is set to the maximum amount of enabled boiling, and an amount of boiling obtained by subtracting the amount of boiling shifted to one for 3 a.m. to 6 a.m. from the amount of boiling originally planned for 9 a.m. to 12 p.m. is conducted in 9 a.m. to 12 p.m.

If the electricity unit price for 9 a.m. to 12 p.m. is higher than each of the electricity unit price for 3 a.m. to 6 a.m. and the electricity unit price for 6 a.m. to 9 a.m., a method of correcting the plan is different depending on the electricity unit price for 3 a.m. to 6 a.m. and the electricity unit price for 6 a.m. to 9 a.m.

If the electricity unit price for 3 a.m. to 6 a.m. is lower, the plan is changed such that the amount of boiling that is originally planned for 9 a.m. to 12 p.m. is to be conducted in 3 a.m. to 6 a.m. If, due to this, the amount of boiling exceeds the maximum amount of boiling that is enabled in 3 a.m. to 6 a.m., an amount of boiling in 3 a.m. to 6 a.m. is set to the maximum amount of enabled boiling.

An amount of boiling obtained by subtracting the amount of boiling shifted to one for 3 a.m. to 6 a.m. from the amount of boiling originally planned for 9 a.m. to 12 p.m. is conducted in 9 a.m. to 12 p.m. Furthermore, the amount of boiling for 9 a.m. to 12 p.m. changed as described above is changed to be conducted in 6 a.m. to 9 a.m. If, due to this, the amount of boiling exceeds the maximum amount of boiling that is enabled in 6 a.m. to 9 a.m., an amount of boiling in 6 a.m. to 9 a.m. is set to the maximum amount of enabled boiling.

An amount of boiling obtained by subtracting the amount of boiling shifted to one for 6 a.m. to 9 a.m. from the amount of boiling for 9 a.m. to 12 p.m. changed as described above is conducted in 9 a.m. to 12 p.m.

If the electricity unit price for 9 a.m. to 12 p.m. is lower than each of the electricity unit price for 3 a.m. to 6 a.m. and the electricity unit price for 6 a.m. to 9 a.m., the amount of boiling that is originally planned for 9 a.m. to 12 p.m. is changed to be conducted in 6 a.m. to 9 a.m. If, due to this, the amount of boiling exceeds the maximum amount of boiling that is enabled in 6 a.m. to 9 a.m., an amount of boiling in 6 a.m. to 9 a.m. is set to the maximum amount of enabled boiling.

An amount of boiling obtained by subtracting the amount of boiling shifted to one for 6 a.m. to 9 a.m. from the amount of boiling originally planned for 9 a.m. to 12 p.m. is conducted in 9 a.m. to 12 p.m.

Furthermore, the amount of boiling for 9 a.m. to 12 p.m. changed as described above is changed to be conducted in 3 a.m. to 6 a.m. If, due to this, the amount of boiling exceeds the maximum amount of boiling that is enabled in 3 a.m. to 6 a.m., an amount of boiling in 3 a.m. to 6 a.m. is set to the maximum amount of enabled boiling. An amount of boiling obtained by subtracting the amount of boiling shifted to one for 3 a.m. to 6 a.m. from the amount of boiling for 9 a.m. to 12 p.m. changed as described is conducted in 9 a.m. to 12 p.m.

For 12 p.m. and later, through the same procedure, boiling for each three hours is shifted to a time slot having a low unit price among the times before the time planned by the method in Embodiment 1. Time slot setting for prediction, planning, and correction may not be fixed to every three hours and may be setting corresponding to the electricity unit price by time slot.

It should be noted that regarding a method of correction, that is, [Operation of operation plan correction unit 5], review of a cluster is performed by the correction method described in Embodiment 1. Furthermore, an amount of boiling after the current time is changed based on the same idea as the method of correcting the plan in consideration of the electricity unit price as described in Embodiment 2.

Advantageous Effects of Hot Water Supply System According to Embodiment 2

In addition to the advantageous effects of the hot water supply system according to Embodiment 1, the hot water supply system according to Embodiment 2 is able to reduce the running cost by making an operation plan and changing the operation plan in consideration of the electricity unit price.

Embodiment 3

Figure 12:
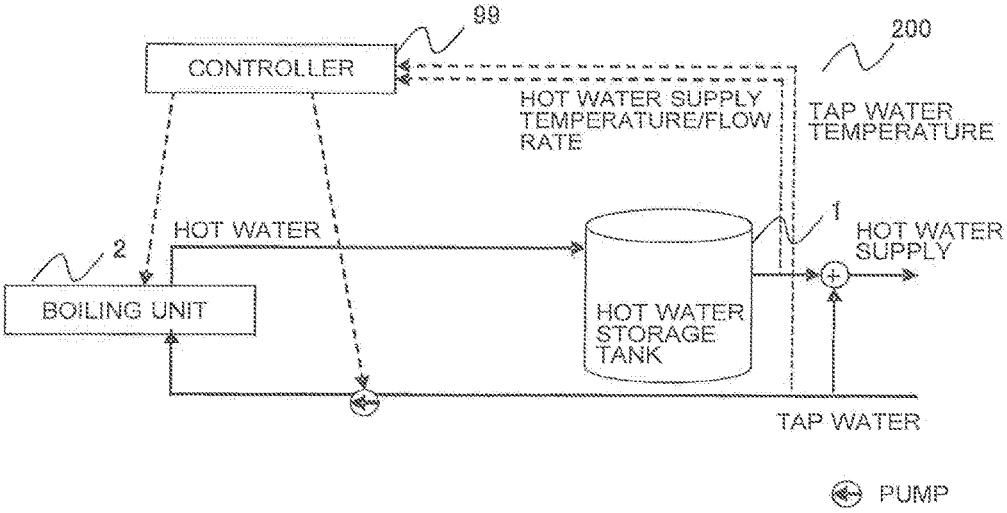
FIG. 12 is a configuration diagram of a hot water supply system according to Embodiment 3 of the present invention.

FIG. 12 is a configuration diagram of a hot water supply and heating system 200 according to Embodiment 3 of the present invention. In Embodiment 3, the difference from Embodiments 1 and 2 will be mainly described. The hot water supply system 100 of each of Embodiments 1 and 2 relates to hot water feeding for hot water supply, but Embodiment 3 relates to the hot water supply and heating system 200.

In this case, it is not always possible to supply hot water at the hot water supply side at any time. Generation of an operation plan and correction thereof at the hot water supply side may be performed in response to a request from the heating side (e.g., room temperature control).

It should be noted that basically, either one of a hot water supply operation or a heating operation may be prioritized, but, for example, when the room temperature is very low, a heating operation has to be preferentially performed. In such a case, a hot water supply operation is temporarily stopped during execution of control based on the method described in Embodiments 1 and 2. However, even when the hot water supply operation is stopped, control is performed by the boiling operation unit 7 such that a predicted hot water supply load for each three hours is conducted in the predicted three hours.

Advantageous Effects of Hot Water Supply and Heating System 200 According to Embodiment 3

Although the hot water supply and heating system 200 according to Embodiment 3 is configured to use heat generated by the boiling unit 2, for heating, not for hot water supply, the hot water supply and heating system 200 provides the same advantageous effects as those of the hot water supply system 100 of each of Embodiments 1 and 2.

| Reference Signs List | |
|---|---|
| 1 | hot water storage tank |
| 2 | boiling unit |
| 3 | hot water supply load data storage unit |
| 4 | operation plan generation unit |
| 5 | operation plan correction unit |
| 6 | hot water supply load data analysis unit |
| 7 | boiling operation unit |
| 8 | heat exchange unit |
| 9 | data measurement unit |
| 10 | hot water supply load data calculation unit |
| 20A | primary side pump |
| 20B | secondary side pump |
| 99 | controller |
| 100 | hot water supply system |
| 200 | hot water supply and heating system |
| A | primary side circuit |
| B | secondary side circuit |

The invention claimed is:

1. A hot water supply system comprising:

a hot water storage tank that stores water;

a boiling unit that is a heating source that heats the water stored in the hot water storage tank; and a controller that determines an amount of heat to be generated by the boiling unit, for each time slot in order to heat the water stored in the hot water storage tank, wherein the controller includes:

a hot water supply load data storage unit that stores hot water supply load data generated on the basis of at least a water temperature of water flowing into the hot water storage tank and a water temperature and a flow rate of water flowing out from the hot water storage tank, for a plurality of days;

a hot water supply load data analysis unit that analyzes the hot water supply load data for the plurality of days stored in the hot water supply load data storage unit;

an operation plan generation unit that predicts a hot water supply load for a predetermined day ahead of the plurality of days stored in the hot water supply load data storage unit, on the basis of the analysis by the hot water supply load data analysis unit, and generates an operation plan for the boiling unit at the predetermined day on the basis of a result of prediction; and an operation plan correction unit that, after start of operation based on the operation plan, predicts a subsequent hot water supply load at the predetermined day on the basis of a hot water supply load result at the predetermined day, and generates a subsequent operation plan at the predetermined day by changing the operation plan generated by the operation plan generation unit, on the basis of the hot water supply load predicted again and a remaining amount of stored hot water in the hot water storage tank, and the hot water supply load data analysis unit classifies the hot water supply load data for the plurality of days stored in the hot water supply load data storage unit, into a plurality of groups, the operation plan generation unit selects one of the plurality of classified groups having an occurrence frequency higher than a predetermined probability and generates the operation plan for the boiling unit on the basis of hot water supply load data of the selected group, and the operation plan correction unit selects at least one of the groups having a low error from the hot water supply load result at the predetermined day after start of operation based on the operation plan, and generates the subsequent operation plan at the predetermined day on the basis of the selected hot water supply load data.

2. The hot water supply system of claim 1, wherein if the hot water supply load result at the predetermined day is lower than the operation plan, the operation plan correction unit decreases an amount of heat to be generated by the boiling unit for each time slot in the operation plan, and if the hot water supply load result at the predetermined day is higher than the operation plan, the operation plan correction unit increases the amount of heat to be generated by the boiling unit for each time slot in the operation plan.

3. The hot water supply system of claim 1, wherein the operation plan correction unit selects a group having a low weighted square error from among the plurality of groups analyzed by the hot water supply load data analysis unit, on the basis of a square error of a hot water supply result at the predetermined day and weights of the groups, and changes a subsequent hot water supply load at the predetermined day on the basis of a hot water supply load of the selected group.

4. The hot water supply system of claim 1, wherein the hot water supply load data storage unit stores the hot water supply load data for a weekday, and the hot water supply load data analysis unit, the operation plan generation unit, and the operation plan correction unit perform calculation on the basis of the hot water supply load data of the weekday.

5. The hot water supply system of claim 1, wherein the hot water supply load data storage unit stores the hot water supply load data for a holiday, and the hot water supply load data analysis unit, the operation plan generation unit, and the operation plan correction unit perform calculation on the basis of the hot water supply load data of the holiday.

6. A hot water supply system, comprising: a hot water storage tank that stores water; a boiling unit that is a heating source that heats the water stored in the hot water storage tank; and a controller that determines an amount of heat to be generated by the boiling unit, for each time slot in order to heat the water stored in the hot water storage tank, wherein the controller includes: a hot water supply load data storage unit that stores hot water supply load data generated on the basis of at least a water temperature of water flowing into the hot water storage tank and a water temperature and a flow rate of water flowing out from the hot water storage tank, for a plurality of days; a hot water supply load data analysis unit that analyzes the hot water supply load data for the plurality of days stored in the hot water supply load data storage unit; an operation plan generation unit that predicts a hot water supply load for a predetermined day ahead of the plurality of days stored in the hot water supply load data storage unit, on the basis of the analysis by the hot water supply load data analysis unit, and generates an operation plan for the boiling unit at the predetermined day on the basis of a result of prediction; and an operation plan correction unit that, after start of operation based on the operation plan, predicts a subsequent hot water supply load at the predetermined day on the basis of a hot water supply load result at the predetermined day, and generates a subsequent operation plan at the predetermined day by changing the operation plan generated by the operation plan generation unit, on the basis of the hot water supply load predicted again and a remaining amount of stored hot water in the hot water storage tank, wherein a time slot including a plurality of consecutive time slots is set as an analysis time slot, a hot water supply load in each of the plurality of time slots constituting the analysis time slot is defined as analysis time slot hot water supply load data, the hot water supply load data storage unit stores the analysis time slot hot water supply load data for a plurality of days, the hot water supply load data analysis unit classifies the analysis time slot hot water supply load data for the plurality of days stored in the hot water supply load data storage unit, into a plurality of groups on the basis of a magnitude of a hot water supply load in each time slot, the operation plan generation unit selects a group from among the plurality of groups on the basis of an occurrence frequency of the analysis time slot hot water supply load data, predicts a hot water supply load within the analysis time slot at the predetermined day based on the analysis time slot hot water supply load data of the group selected from among the plurality of groups, and generates the operation plan for the analysis time slot at the predetermined day on the basis of the result of the prediction, and after start of operation based on the operation plan, the operation plan correction unit generates a subsequent operation plan for subsequent another time slot within the analysis time slot at the predetermined day on the basis of a hot water supply load result in at least one time slot within the analysis time slot at the predetermined day.

7. The hot water supply system of claim 6, wherein the hot water supply load data analysis unit classifies the analysis time slot hot water supply load data for the plurality of days stored in the hot water supply load data storage unit, into the plurality of groups on the basis of a time slot in which a hot water supply load of each analysis time slot hot water supply load data is maximum.

8. The hot water supply system of claim 6, wherein the hot water supply load data analysis unit classifies the analysis time slot hot water supply load data for the plurality of days stored in the hot water supply load data storage unit, into the plurality of groups on the basis of a time slot in which a hot water supply load of each analysis time slot hot water supply load data is maximum and a time slot in which a hot water supply load is second highest.

9. The hot water supply system of claim 6, wherein the controller divides 1 day into a plurality of the analysis time slots, and performs analysis of hot water supply load data and generation of the operation plan for each analysis time slot.

* * * * *